United States Patent [19]

Swift

[11] 4,037,574

[45] July 26, 1977

[54] TIMING CONTROL FOR FUEL INJECTION PUMP

[75] Inventor: Joseph Edward Swift, South Windsor, Conn.

[73] Assignee: Stanadyne, Inc., Windsor, Conn.

[21] Appl. No.: 688,829

[22] Filed: May 21, 1976

[51] Int. Cl.[2] ..... F02M 59/20

[52] U.S. Cl. ..... 123/139 AQ; 123/139 ST; 123/179 L; 417/221

[58] Field of Search ..... 123/139 AM, 139 BD, 123/139 AP, 139 AQ, 140 FG; 417/218, 221, 462

[56] References Cited

U.S. PATENT DOCUMENTS

| | | | |
|---|---|---|---|
| 2,910,975 | 11/1959 | Evans | 123/139 AQ |
| 3,394,688 | 7/1968 | Roosa | 123/139 AQ |
| 3,943,902 | 3/1976 | Skinner | 123/139 AQ |
| 3,968,779 | 7/1976 | Davis | 123/139 AQ X |

*Primary Examiner*—Carroll B. Dority, Jr.
*Assistant Examiner*—Tony M. Argenbright
*Attorney, Agent, or Firm*—Prutzman, Hayes, Kalb & Chilton

[57] ABSTRACT

In a fuel injection pump having a cam and pump plungers movable relative to the cam to translate the contour of the cam into a sequence of pumping strokes. An advance piston connected to the cam to adjust the timing of the pumping strokes is controlled by a hydraulic pressure which increases with engine speed. The advance piston mounts a servo valve having a preloaded biasing spring to prevent the delivery of hydraulic pressure to act on said advance piston until a predetermined speed is reached. A movable stop controls the maximum retard position of the advance piston and responds to the hydraulic pressure which is continuously applied to the movable stop and acts to advance the timing a fixed amount as soon as the engine fires. A load sensing piston actuated by a load related source of fluid pressure is operatively connected to the other end of the advance piston to urge the advance piston in a direction to retard the timing of the pumping stroke in response to increased engine load.

6 Claims, 2 Drawing Figures

FIG. 1
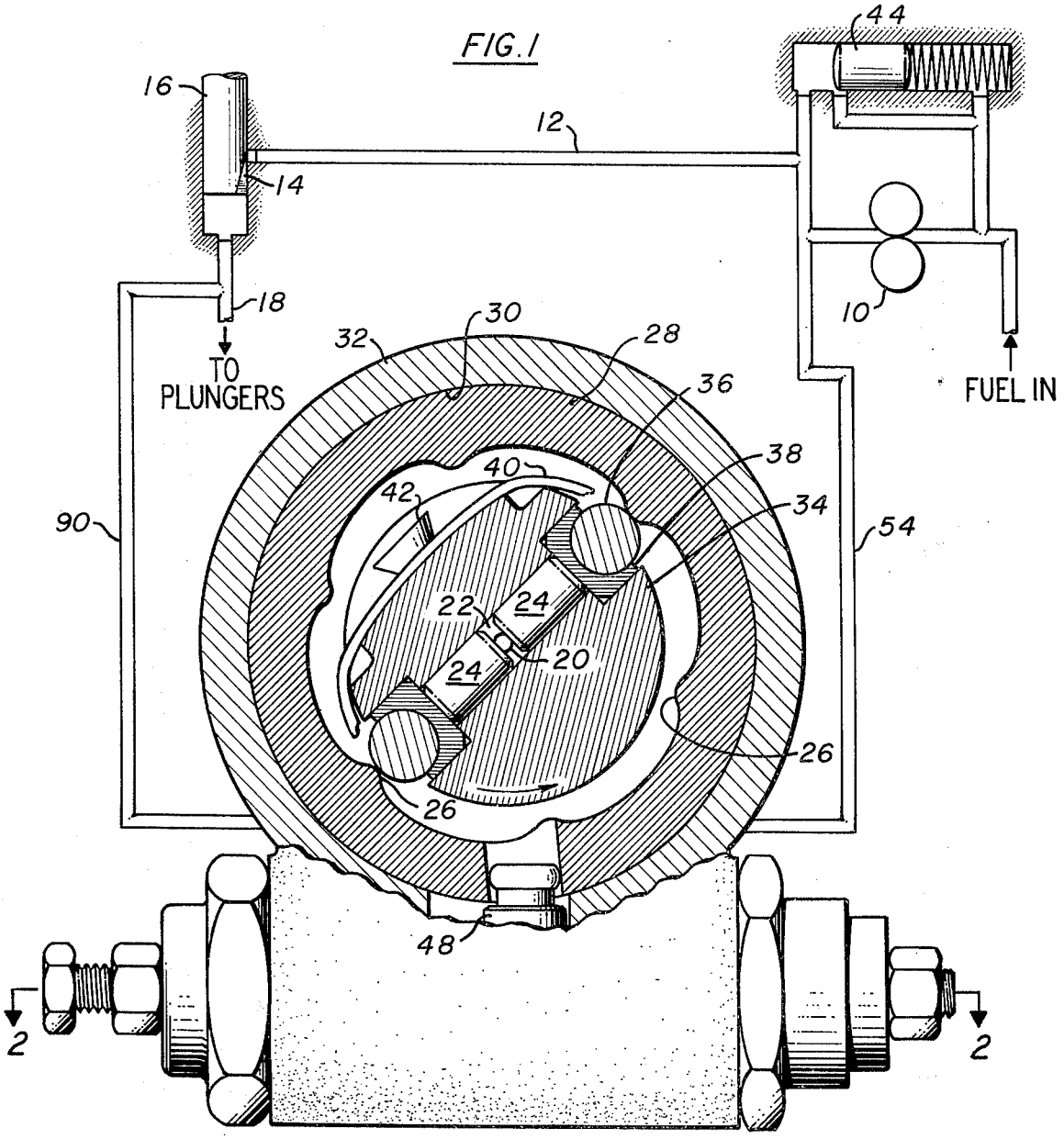
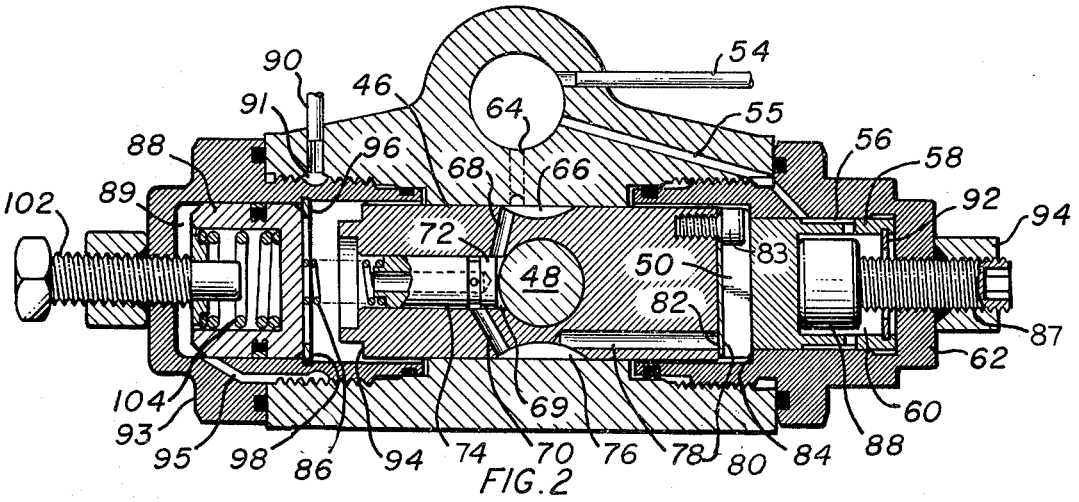
FIG. 2

TIMING CONTROL FOR FUEL INJECTION PUMP

This invention relates to liquid fuel injection pumps for internal combustion engines and more particularly to an improvement in such fuel pumps for retarding the injection timing of the pump during starting.

Fuel injection pumps of the type referred to above deliver metered charges of liquid fuel under high pressure in sequence to the several cylinders of an associated engine in timed relation therewith. A cam ring of the pump having inwardly directed cam lobes surround one or more rotor mounted pumping plungers which produce the high pressure charges of fuel so as to move the pump plungers bodily relatively to the cam to translate the configuration of the cam lobes to the desired timed pumping strokes.

In order to increase the efficiency and smoothness of operation of the engine, it is frequently the practice to advance the timing of injection of fuel to the cylinders at increased engine speeds. This may be accomplished by adjusting the angular position of the cam which is mounted for limited angular movement and is restrained from rotating by an advance piston and a connecting pin.

In certain types of engines, it has also been found desirable to retard the timing a controlled amount more during the starting of the engine than after the engine is started.

It is the primary object of the invention to provide an improved timing means for a fuel injection pump which retards the timing of the pump during the starting of the engine associated with the pump. Included in this object is the provision of a timing control wherein the injection timing is promptly advanced a controlled amount after the engine is started.

It is a further object of the invention to provide a new and novel injection timing means which provides a prescribed amount of timing advance immediately after the engine is started.

Other objects will be in part obvious and in part pointed out more in detail hereinafter.

A better understanding of the invention will be obtained from the following detailed description and the accompanying drawing of an illustrative application of the invention.

In the drawing:

FIG. 1 is an end elevation view, partially in section and partly schematic, of a fuel pump incorporating the invention; and FIG. 2 is a cross-sectional view taken along line 2—2 of FIG. 1.

Referring now to the drawing in detail, there is illustrated a fuel pump suitable for the practice of the present invention. Such a pump is similar to that disclosed and claimed in U.S. Pat. No. 3,771,506 which issued Nov. 13, 1973.

As shown, fuel under pressure is delivered from the output of the transfer pump 10 to a passage 12 for delivery to a metering valve passage 14 wherein a metering valve 16 provides a variable restriction to control the flow of fuel delivered by passage 18 which is connected by rotor passage 20 to pump chamber 22 of the high pressure pump shown as comprising a pair of reciprocable pump plungers 24 which are simultaneously urged inwardly by cam lobes 26 of a cam ring 28 which is mounted for limited angular movement in a bore 30 of the pump housing 32.

As is now well known in the art, rotor passage 20 sequentially registers with passage 18 as the rotor 34 rotates when the pump plungers 24 are free to move outwardly to charge the pump chamber 22 with a charge of fuel the amount of which is determined by the setting of the metering valve. Continued rotation of the rotor 34 interrupts the communication between the rotor passage 20 and the passage 18 and the cam rollers 36 engage the cam lobes 26, as shown in FIG. 1, and act through roller shoes 38 to force the plungers 24 inwardly to pressurize the fuel contained in pump chamber 22 to high pressure. The high pressure fuel in the pump chamber 22 is delivered by the passage 20 to a series of passages, not shown, positioned around the distributor rotor 34 for sequential registry with the passage 20 in a well-known manner to deliver the charges of fuel from the pump chamber 22 sequentially to the several cylinders of the associated engine.

The maximum outward radial movement of the shoes 38 is limited by the ends of the leaf spring 40 adjustably mounted by a screw 42.

A spring biased pressure regulating valve 44 is provided to control the output pressure from the transfer pump 10 so that it varies with the speed of the engine driving the fuel pump.

To vary the timing of injection of the fuel into the associated cylinders of the engine, the cam ring 28 is mounted in a bore 30 in the pump housing 32 for limited angular movement to adjust the angular position of the cam lobes 26. The cam ring 28 is restrained from rotating by piston 46 of the automatic advance mechanism and a connecting pin 48.

As shown in the drawing, a closed chamber 60 is formed between stop piston 58 and cap sleeve 62 and receives liquid fuel through the passage 54, which is connected to the outlet of transfer pump 10, via passage 55 and annulus 56 which is in open communication with pressure chamber 60 formed by the cap sleeve 62.

Passage 54 also delivers output pressure from the transfer pump 10 to the power chamber 50 through passage 64, slot 66 in advance piston 46, passage 68, and passage 70 which is selectively in communication with passage 68 when the land 72 of servo piston 74 is moved to the left to uncover passage 70.

When passage 70 communicates with passage 68, the output of transfer pump 10 is delivered by slot 76 and axial passage 78 to power chamber 50. A flat annular valve 80 overlies the port 82 in the wall of power chamber 50 and is mounted by means of a pair of mounting screws 83 (only one of which is shown) to provide a flat ring seal for controlling one-way flow of fuel into the chamber 50. High impact pulses of pressure produced on the rollers 36 riding over the cam lobes 26 automatically seats the valve 80 to trap the fuel in power chamber 50 and to prevent reverse flow in passage 78.

Leakage past piston 46 allows the gradual bleeding of fuel from chamber 50 as the amount of fuel in chamber 50 decreases to allow advance piston 46 to assume a new position of equilibrium at lower engine speed.

So far as the structure of the cam and the adjusting mechanism just described are concerned, these are generally similar to those described in prior U.S. Pat. No. 3,771,506.

As shown, the end of advance piston 46 engages a shoulder 84 formed in the cap sleeve 62 to fix the maximum retard position of the piston 46 when it is bottomed against the shoulder 84 of the cap sleeve 62. The axial position of shoulder 84 is established so as to provide the additional retarded timing of injection desired during the cranking period, it being understood that when the engine is being cranked for starting, advance piston 46 is moved to the right, as shown in FIG. 2, so that it is bottomed against the shoulder 84 due to reaction forces between cam lobes 26 and the rollers 36.

At cranking speeds, the output pressure from transfer pump 10 is low and is insufficient to move advance piston 46 to the left as a result of the pressure in chamber 60 acting on movable stop piston 58 against the bias produced by the reaction forces produced by the rollers 36 on the cam lobes 26. At this time, the output pressure of the transfer pump is inadequate to move servo piston 74 to the left against the bias of a biasing spring 86 to uncover port 70 to deliver fuel at transfer pump output pressure to the chamber 50.

As soon as the engine fires, it begins to pick up speed, and transfer pump output pressure increases. When the engine attains the speed of say, 300 to 400 r.p.m., transfer pump pressure is high enough to move the movable stop piston 58 to the left against the reaction forces. This in turn mechanically moves the advance piston 46 to the left to increase the timing of injection a fixed amount determined by the engagement between the head 88 of adjusting screw 87 and split washer 92 which is mounted in a groove of the piston 58. The adjusting screw 87 is axially adjustable by being threaded into cap screw 62 and is held in adjusted position by a lock nut 94.

When movable stop piston 58 is moved to its maximum position to the left, the timing of the injection remains fixed until the pressure in chamber 69 increases enough to move servo piston 74 to the left against the bias of spring 86. When the servo piston 74 moves to the left a sufficient amount to expose the end of passage 70, fuel is delivered from passage 68 to chamber 50 until advance piston 46 is moved to the left relative to servo piston 74 to close off communication between chamber 69 and passage 70 thereby to result in a timing of injection which is advanced according to engine speed.

Thus, this invention provides for the retardation of the timing of injection by a fixed amount as a result of the operation of movable stop piston 58 as hereinbefore described followed by a fixed amount of advance in the injection timing immediately after the engine begins to fire.

If desired, the left end of spring 86 may be longitudinally fixed. However, as shown, load sensing piston 88 serves as a movable spring seat for spring 86.

With such a construction, the advance mechanism operates as follows:

During cranking, injection timing is retarded with the end of advance piston 46 bottomed on the mating shoulder 84 in the cap sleeve 62 since the biasing force of the spring 86 is greater than the hydraulic force acting on movable stop piston 58 in chamber 60 due to the low output pressure of tansfer pump 10 during cranking.

When the engine starts, the output pressure of transfer pump 10 increases the hydraulic force in chamber 60 to move stop piston 58 to the left until split ring stop 92 engages head 88. Engagement between stop piston 58 and advance piston 46 moves advance piston 46 causing cam ring 28 to turn in the direction opposite to the rotation of rotor 34 to advance injection timing a fixed amount.

Thereafter, the amount of timing advance is controlled by servo piston 74.

When the engine is operating at high speed and low load, injection timing is at maximum advance with the shoulder 94 of the advance piston 46 in engagement with the split ring stop 96 positioned in groove 98 of cap sleeve 93 since the metering valve 16 is nearly closed and the pressure in passage 90 is low so that the load sensing piston 88 does not prevent the advance piston 46 from reaching its position of maximum advance.

When load on the engine increases, the metering valve 16 is opened an increased amount thereby increasing the hydraulic pressure in the passage 90 and in the chamber 89 for powering the load sensing piston to the position shown in FIG. 2. This increased pressure in chamber 89 compresses the biasing spring 86 to move the advance piston 46 in the same direction as rotor rotation against the bias of the hydraulic pressure in chamber 50 until an equilibrium position is reached.

When the load on the engine reaches full load at high speed, the metering valve is opened the maximum amount to raise the pressure in chamber 89 to its maximum level. This causes the load sensing piston 88 to assume its extreme position bottomed against the split stop ring 96 to lessen the amount of advance of injection timing so that the injection timing at full load is less than it is at low load.

If desired, a trimmer screw 102 and a bias spring 104 can be added to the load sensing piston construction for tailoring advance performance to specific applications.

As will be apparent to persons skilled in the art, various modifications, adaptations and variations can be made from the foregoing specific disclosure without departing from the teachings of the present invention.

I claim:

1. In a fuel injection pump for an internal combustion engine, pump plunger means providing sequential pumping strokes, means for changing the timing of the pumping strokes comprising a cylinder, an advance piston movable in said cylinder, means interconnecting said advance piston with said pump plunger means to advance and to retard the relative timing of the pumping strokes, a source of fluid having a pressure correlated with engine speed, a first hydraulic chamber at one end of said advance piston connected to said source of fluid to move the advance piston to advance the timing of the pumping strokes in response to increased engine speed, means for controlling the delivery of fluid from said source to said first hydraulic chamber, said means including means for preventing the delivery of fluid to said first hydraulic chamber until a predetermined speed is reached thereby to retard the timing of the pumping strokes during engine cranking, movable stop means engageable with said advance piston, a second hydraulic chamber for receiving fluid from said source to urge said movable stop toward said advance piston, and means providing continuous communication between said fluid source and said second hydraulic chamber whereby said movable stop limits the maximum retard position of said advance piston to a lesser amount as soon as the engine starts.

2. The combination of claim 1 wherein said means for controlling the delivery of fluid from said source to said first hydraulic chamber also includes a valve for venting said first hydraulic chamber until said predetermined speed is reached.

3. The combination of claim 2 wherein said advance piston has a bore and said control means is a servo valve mounted in said bore and a preloaded spring biases said servo valve to its engine starting position.

4. The combination of claim 2 including a load sensing piston positioned in said cylinder at the end opposite said movable stop, a source of fluid under a pressure correlated with the load on the engine, a third hydraulic chamber for receiving fluid from said load related source of fluid pressure, said load sensing piston being operatively connected to said advance piston to move the advance piston in the direction to retard the timing of said pumping strokes in response to increased engine load.

5. The combination of claim 4 wherein a stop is provided for limiting the movement of said load sensing piston in a direction to retard the timing of said pumping strokes to render the load sensing piston inoperative to modify the timing of said pumping strokes when the load exceeds a predetermined amount.

6. The combination of claim 4 wherein said load sensing piston provides the spring seat for said servo valve.

* * * * *